United States Patent [19]

Speer

[11] Patent Number: 5,052,059

[45] Date of Patent: Oct. 1, 1991

[54] WEDDING GOWN TRAIN HOOP WITH INTEGRAL WRIST STRAP

[76] Inventor: Nancy D. Speer, P.O. Box 1257, Carthage, N.C. 28327

[21] Appl. No.: 659,894

[22] Filed: Feb. 25, 1991

[51] Int. Cl.[5] ..... A41F 19/00

[52] U.S. Cl. ..... 2/336; 2/271; 2/321; 2/170; 2/162

[58] Field of Search ..... 2/336, 271, 321, 170, 2/162

[56] References Cited

U.S. PATENT DOCUMENTS 797,037 8/1905 White ..... 2/321

1,059,869 4/1913 Hatfield ..... 2/321

*Primary Examiner*—Werner H. Schroeder

*Assistant Examiner*—Gloria Hale

*Attorney, Agent, or Firm*—Rhodes, Coats & Bennett

[57] ABSTRACT

The present invention relates to a wedding grown train hoop that is provided with a wrist strap that enables the bride or dress wearer to carry and support the hoop about the wrist. In particular, the wedding train hoop of the present invention entails a hoop having first and second ends connected together by a friction pin or screw. A decorative sock is disposed about the hoop and includes a wrist section that is formed at the juncture of the first and second ends of the hoop and extends from the hoop to form a wrist strap or loop.

8 Claims, 2 Drawing Sheets

WEDDING GOWN TRAIN HOOP WITH INTEGRAL WRIST STRAP

BACKGROUND OF THE INVENTION

Dresses, particularly wedding dresses, may have a train or trailing portion that extends behind the dress wearer. This dress train may make walking unnecessarily difficult if the train is not properly positioned behind the dress wearer. Dress train hoops have been used in the past to help dress wearers control and adjust the position of the trailing or train portion of the dress. Train hoops of the prior art normally consist of a circular hoop. To use a dress train hoop, the train of a dress is inserted through the hoop and the hoop itself is held to help control the positioning of the dress train.

SUMMARY AND OBJECTS OF THE INVENTION

The present invention train hoop improves prior art train hoops by providing a train hoop with an integrally connected wrist strap to enable a user to more effectively handle and control the train hoop.

The train hoop with integral wrist strap includes a circular hoop, a decorative hoop sock, and a ribbon. The circular hoop has two adjacent terminal ends that can be connected together such that the hoop forms a continuous, enclosed circle. The decorative stock is fitted over the circular hoop so that part of the stock covers the circular hoop. Another section of the sock, the wrist strap section, extends beyond one end of the circular hoop and the terminal end of this section is fixed between the circular hoop's two adjacent ends to form an integral wrist strap. A ribbon is tied about the circular hoop where the hoop's adjacent ends are connected to cover the connection and for additional decoration.

Accordingly, it is an object of the present invention to provide a train hoop with a wrist strap that a user puts over her wrist while carrying the hoop.

Another object of the present invention is to provide a wrist strap that is integral with a decorative stock fitted about the circular hoop.

Another object of the present invention is to provide a train hoop that is efficiently, easily and quickly constructed.

Other objects and advantages of the present invention will become apparent and obvious from a study of the following description and the accompanying drawings which are merely illustrative of such invention.

DETAILED DESCRIPTION OF THE INVENTION

Figure 1:
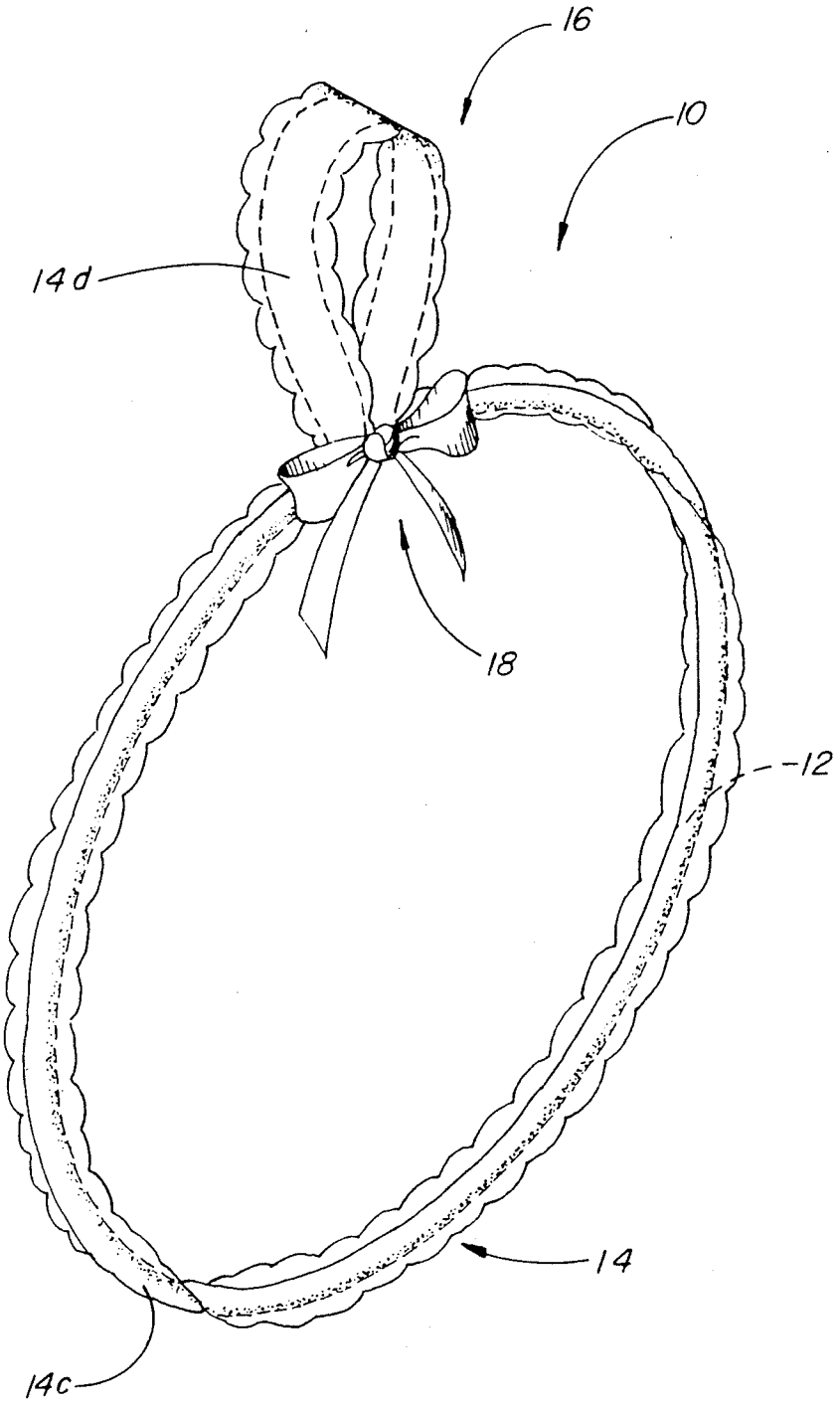
FIG. 1 is a perspective view of the wedding gown train hoop of the present invention.

The present invention entails a wedding gown train hoop which is indicated in the drawings generally by the reference numeral 10. Train hoop 10 includes a hoop structure 12 that can be constructed of various materials but in a preferred embodiment, the hoop is constructed of a solid PVC material. As shown in FIG. 2, hoop 12 includes two terminal ends 12*a* and 12*b*. End 12*a* has formed therein a friction pin 12*c* that is adapted to frictionally fit into a friction pin opening 12*d* formed in end 12*b*. The friction type connection formed by friction pin 12*c* and opening 12*d* is such that the hoop can be secured in a closed configuration as shown in FIG. 1 or can be separated in an open configuration as illustrated in FIG. 2.

Secured about the hoop structure 12 is an elongated sock indicated generally by the numeral 14. Sock 14 includes a closed end 14*a* that fits over end 12*b* of the hoop structure 12. In addition, sock 14 includes an opposite end 14*b*. Also, sock 14 includes a hoop covering section 14*b* that extends between the ends 12*a* and 12*b* of the hoop structure 12. Extending from hoop end 12*a* is a wrist strap section 14*d* that forms a wrist strap indicated generally by the numeral 16 (FIG. 1).

Thus, it is apreciated that the stock 14 extends from its closed end 14*a* around the hoop structure 12 to the opposite end 12*a* where the sock 14 is pulled such that the friction pin 12*c* pierces the sock, as shown in FIG. 2. Thus, the wrist strap section 14*d* is formed. To form the wrist strap 16, the wrist strap section 14*d* is essentially looped to where the friction pin 12*c* is extended back through an opening 14*e* formed in the end portion 14*d* of the sock. This, as illustrated in FIG. 1, forms the wrist strap 16. It is thusly seen that the friction pin 12*c* extends through and from the sock 14 and also extends through opening 14*e* formed in the wrist strap end 14*d* of the stock 14.

Figure 2:
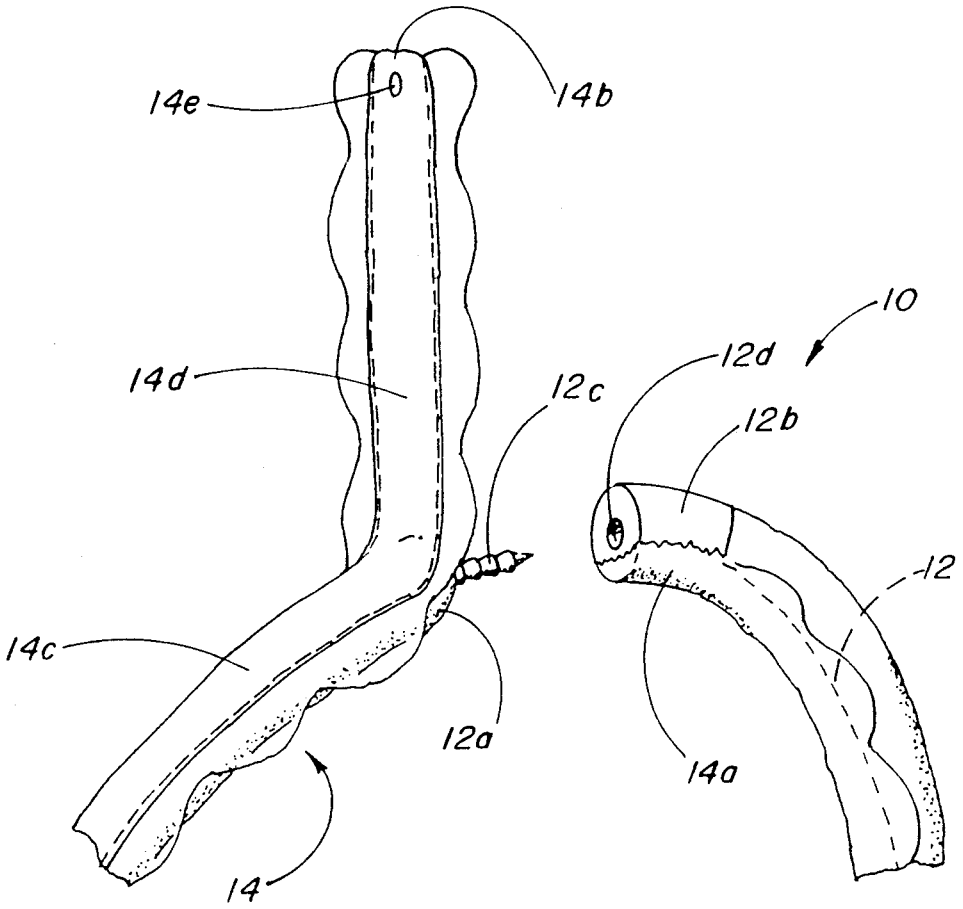
FIG. 2 is a fragmentary perspective view of the train hoop showing the two terminal ends of the hoop structure in a separated and disconnected position.

Finally, a ribbon formed into a bow 18 is tied around the hoop structure 12 such that the bow 18 lies adjacent the wrist strap 16, as illustrated in FIG. 1.

In use, the train portion of a wedding gown is extended through the hoop structure where the hoop essentially carries the trailing or train portion of the wedding gown. The bride or person wearing the dress being supported within the hoop, is able to grasp and support the hoop through the wrist strap 16.

From the foregoing specification and discussion, it is appreciated that the wedding gown train hoop 10 of the present invention presents a simple and economical train hoop design that can easily be carried and supported by engaging and holding the wrist strap 16.

The present invention may, of course, carried out in the specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A wedding gown train hoop with an integral wrist strap, comprising:

a) a hoop having a first end and an adjacent second end;

b) means for connecting the hoop's first and second ends;

c) a continuous hoop sock fitted about the hoop and forming a wrist strap; and d) the hoop sock including a hoop covering section that extends from the hoop's first end to the hoop's second end and a wrist strap section that extends from the hoop's second end to the hoop's first end to form an enclosed wrist strap section adjacent to the hoop.

2. The wedding gown train hoop with integral wrist strap of claim 1 further including a ribbon tied around the section of the hoop where the hoop's first and second ends are connected.

3. The wedding gown train hoop with integral wrist strap of claim 1 wherein the means for connecting the hoop's first and second ends includes an opening formed in the hoop's first end and a projection attached to the hoop's second end that fits into the opening formed in the hoop's first end.

4. The train hoop with integral wrist strap of claim 1 wherein the wrist strap section of the hoop sock includes a first end integrally connected to the hoop covering section and extending from the hoop's second end, and a terminal end that is attached to the hoop between the hoop's first and second ends.

5. A dress train hoop with an integral wrist strap for aiding a dress wearer in controlling the positioning of the dress train, comprising: a hoop having a first end and an adjacent second end; means for connecting the hoop's first and second ends; a hoop sock covering the hoop and forming a wrist strap; the hoop sock having a covering section that extends along the hoop from the hoop's first end to the hoop's second end and a wrist strap section having a first end extending from the hoop covering section and a terminal end fastened between the first and second hoop ends such that the wrist strap section forms an enclosed loop adjacent the hoop.

6. The dress train hoop of claim 5 wherein the hoop is formed of a solid PVC structure.

7. The dress train hoop of claim 6 wherein said connecting means includes an opening formed within one end of the hoop and an elongated friction pin formed in the other end of the hoop wherein the friction pin is designed to be frictionally inserted within the opening.

8. The dress train hoop of claim 7 wherein the elongated friction pin extends through and penetrates opposite end portions of the wrist strap section of the hoop sock.

* * * * *